United States Patent [19]
Elsner et al.
[11] 4,119,792
[45] Oct. 10, 1978

[54] MELTING FURNACE

[75] Inventors: Emil A. Elsner, Baden-Baden; Dieter Ch. Ameling, Neu-Wulmstaf; Rolf Assenmacher, Willstätt; Gerhard Fuchs, Wilstätt-Legelshurst, all of Fed. Rep. of Germany

[73] Assignee: Korf-Stahl AG., Baden-Baden, Fed. Rep. of Germany

[21] Appl. No.: 765,789

[22] Filed: Feb. 4, 1977

[30] Foreign Application Priority Data

Jul. 16, 1976 [DE] Fed. Rep. of Germany ..... 2631982

[51] Int. Cl.[2] ..... F27D 1/12
[52] U.S. Cl. ..... 13/32
[58] Field of Search ..... 13/32, 35; 266/280, 266/282

[56] References Cited

U.S. PATENT DOCUMENTS

| | | | |
|---|---|---|---|
| 3,843,106 | 10/1974 | Nanjyo et al. | 13/32 X |
| 3,940,552 | 2/1976 | Mizuno | 13/32 |

*Primary Examiner*—R. N. Envall, Jr.

[57] ABSTRACT

Melting furnace, especially an arc melting furnace, in which the furnace wall contains at least one water cooling box welded of steel plate and disposed above the melt level, whose surface facing the furnace interior is provided with projections which facilitate the adhesion of a refractory protective layer formed on this surface, wherein the wall of the water cooling box, which faces the furnace interior, has a thickness of at least 15 mm, the projections are formed of profile irons, and a refractory composition applied beforehand serves as the refractory protective layer.

19 Claims, 12 Drawing Figures

MELTING FURNACE

BACKGROUND

Figure 1:
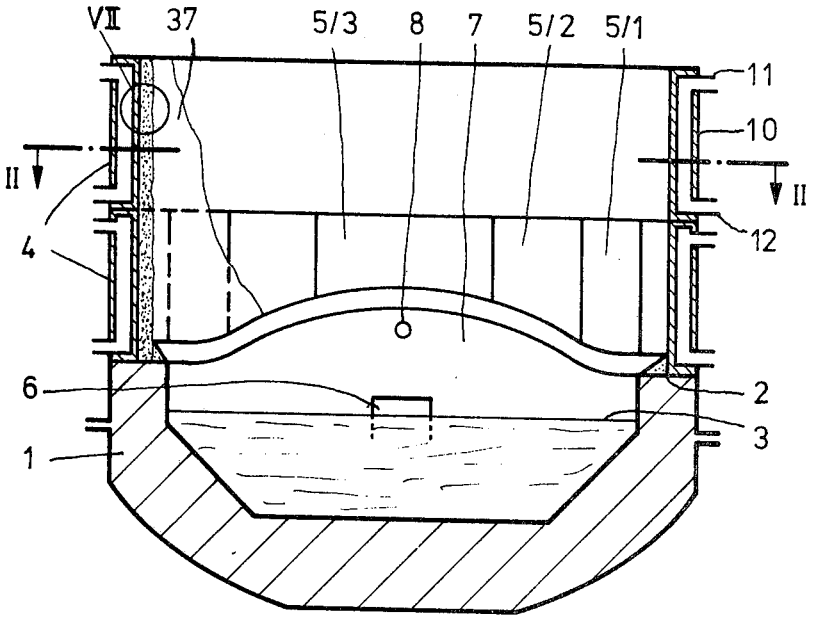

The invention relates to a melting furnace, especially an arc furnace, in which the furnace wall contains at least one water cooling box of welded sheet steel disposed above the melt level, whose surface facing the interior of the furnace is provided with projections which facilitate the adherence of a refractory protective coating formed on this surface.

To extend the life of the lining of melting furnaces, especially arc furnaces, water cooling boxes of welded steel plates have been installed in the furnace wall in back of the brickwork lining for the purpose of cooling the latter. This has not proven to be completely satisfactory, inasmuch as the severe heating of the interior surface of the refractory bricks covering the water cooling box and the cooling action exercised on their exterior surface creates the danger that the bricks may become distorted and break away, exposing the surface of the water cooling box directly to the arc heat of the furnace. Not only does this result in the occurrence of cracks in the walls of the water cooling boxes, especially when the wall thickness is greater than 12 mm, and in the burning of holes into the wall of the water cooling boxes resulting in cooling water leakage and the danger of explosion, but also the thermal efficiency of the furnace is reduced thereby.

A new approach has been taken to the prevention of these disadvantages. The refractory bricks have been removed in the area of the water cooling boxes or cooling tubes as the case may be, and instead the cooling element surface facing the furnace interior has been constructed such that the ability of metal or slag splashes to adhere to it is greatly increased, so that during operation a protective layer of refractory slag builds up on it and adheres tightly to it, protecting the cooling elements and assuring a good heating efficiency. In the system disclosed by German Offenlegungsschrift 2,354,570, the cooling means are constructed of a main body of cast iron or copper and a number of cooling tubes cast directly in the main body, while the surface facing the interior of the furnace is corrugated or is formed with bricks discretely embedded in and projecting from the said surface in order to increase the adhesive-holding ability thereof. In the solution proposed by German Offenlegungsschrift 2,502,712, the cooling elements are water cooling boxes made by welding sheet steel, whose surfaces exposed to the interior of the arc furnace are provided with a plurality of ribs or rod-like projections in a lattice or checkerboard arrangement. After the furnace is placed in operation, a refractory coating of slag forms on the initially bare surface of the cooling boxes in a thickness of up to 20 mm; this coating adheres firmly and assures a good thermal efficiency of the arc furnace.

What is disadvantageous in the cooling system disclosed by German Offenlegungsschrift 2,354,570 is the relatively high cost of the manufacture of the cooling elements constructed as castings. Disadvantageous in the approach disclosed by German Offenlegungsschrift 2,502,712 is the danger that, when the furnace is started up, some of the projections may melt away before a protective layer of slag has formed on them, and then a sufficiently thick protective coating will no longer be able to form at such points, and that, prior to the formation of a suitable coating, the danger of strike-overs by the arc to the water cooling boxes exists, resulting in greater danger of explosion due to water leakage.

THE INVENTION

The invention is addressed to the problem, in a melting furnace of the kind described above, of extending the life of the water-cooled furnace wall without having to accept the above-mentioned disadvantages of known melting furnaces of this type. A firmly adherent, refractory coating of uniform thickness is to be able to form without the occurrence of local melting away of the projections. This protective coating is to be able to be built up in a thickness of more than 20 mm without the danger of spalling off.

This problem is solved by the invention specified in claim 1. Advantageous embodiments and further developments of the invention are to be found in the subordinate claims.

The invention is based upon the knowledge that, if the projections are of a certain shape, namely if they are in the form of profile irons, preferably in the form of hollow profile irons, not only can an improved adhesion of a refractory composition to the water cooling box wall facing the furnace interior be achieved, but also a more uniform cooling of the refractory composition on account of the increased contact surface between the refractory mass and the profile iron. The possibility is thereby created for applying a suitable refractory composition in sufficient thickness prior to the first melting operation which will not only adequately protect the water cooling box wall facing the furnace interior and prevent the arc from striking over to the water cooling box, but will also form a protective coating on the projections which prevents these projections against melting. The refractory composition can be sprayed on, rammed on or applied by centrifugal methods either wet or dry, and it is preferably selected to have a high thermal conductivity and a high melting point. The high thermal conductivity in conjunction with the greater contact surface between the projections and the refractory composition assures a better and more uniform cooling of the refractory composition, which in turn increases its stability and prevents it from spalling off. In contrast to the refractory coating formed by slag spatter, the refractory composition in the melting furnace of the invention can be selected so as to optimize the desired characteristics.

In the case of a ramming composition, the projections are preferably in the form of hollow profiles, and in the case of a spray composition they are preferably in the form of open-topped U-shapes or V-shapes, or in the form of tube sector-shaped profiles with the slot-like opening facing upwardly. The open-topped profiles additionally have the advantage that if, after a long period of operation, the initially applied refractory composition becomes locally damaged, they trap the downwardly dripping slag spatter and thus also facilitate the formation of an additional protective coating by slag if they are spaced apart from one another and staggered in the axial direction of the furnace.

Contrary to the formerly held view (German Offenlegungsschrift 2,354,570, p. 2, last par.), that, in water cooling boxes made of welded sheet steel, the thickness of the wall facing the interior of the furnace must not be greater than approximately 9 to 12 mm, since otherwise the wall will have a greater tendency to crack due to the temperature difference between the high temperature in the furnace and the surface in contact with the cooling water, the same wall in the melting furnace of the invention is at least 15 mm thick and is preferably between 20 and 35 mm thick. This is possible because the protective coating of refractory composition is present from the beginning, and this greater thickness, in conjunction with the special shape of the projections, not only provides a more uniform temperature distribution in the furnace wall, but also reduces the danger of burnout of the steel plate if, under exceptional circumstances, the surface of the water cooling box should nevertheless become exposed. Furthermore, the improved rigidity which this greater thickness provides makes it possible to construct the water cooling box as a self-supporting part of the furnace wall.

For the purpose of effectively forestalling the danger of water leakage into the melting furnace due to cracking resulting from the increased wall thickness under the exceptional circumstances mentioned above, the seams or flanges between the furance brickwork and the water cooling boxes and between the superimposed water cooling boxes are, in a further development of the invention, constructed such that they will catch any water flowing downwardly on the inside of the furnace and carry it to the outside. Furthermore, measures are taken so that, when the furnace is tapped, it will be possible reliably to prevent the melt from getting into the area of the water cooling boxes.

Figure 2:
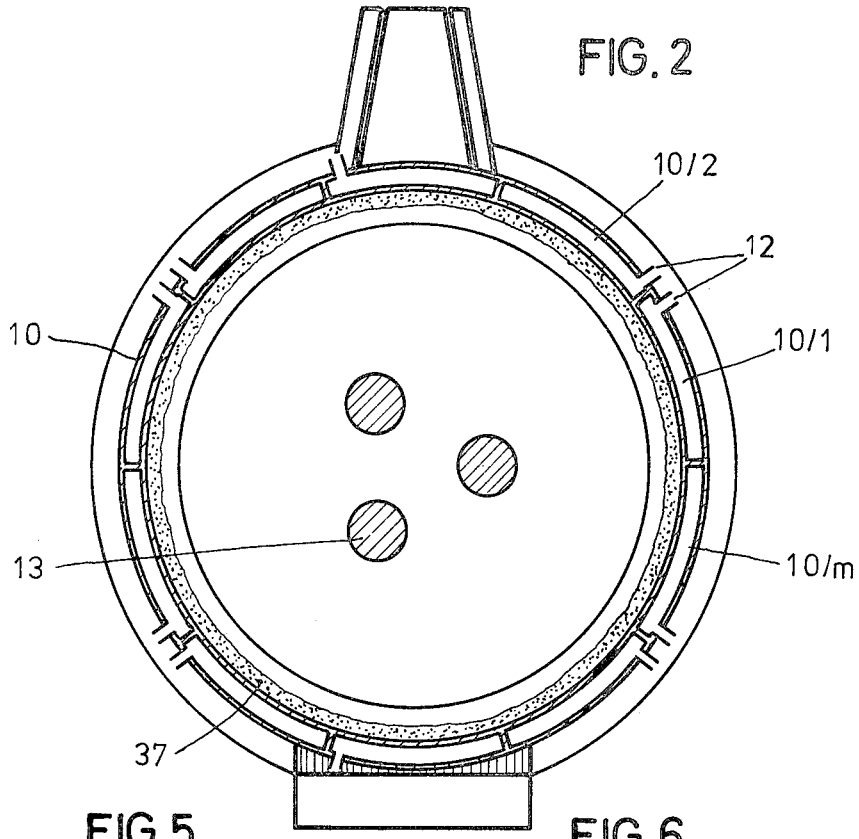
Figure 5:
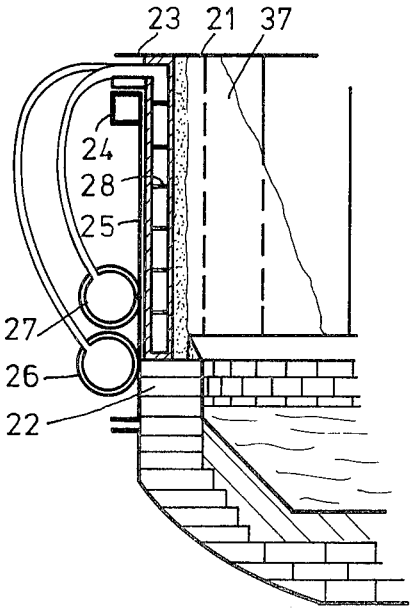
Figure 6:
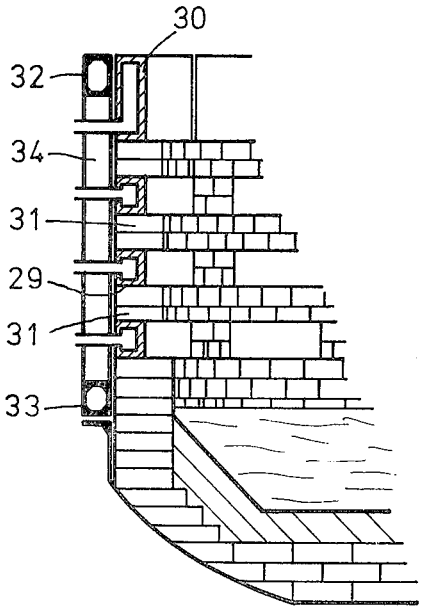
Figure 7:
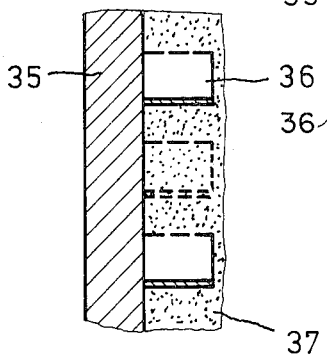

The invention will be explained with the aid of examples of its embodiment represented in twelve figures in the appended drawings:

FIG. 1 is an axial cross-sectional view of a melting furnace in accordance with the invention, with the cover removed, FIG. 2 is a radial cross-sectional view of this furnace taken along line II—II, FIGS. 3 to 6 are partial cross-sectional elevational views of other embodiments of a furnace tank of the invention, FIG. 7 represents an enlarged view of a detail of the furnace wall of FIG. 1, and FIGS. 8 to 12 are face views of portions of the inner walls of various water cooling boxes illustrating different profile shapes of the projections affixed to them by welding.

The furnace tank diagrammatically represented in FIGS. 1 and 2 contains a bowl-like bottom vessel 1 of refractory brick, whose rim 2 is raised by about 30 to 40 cm above the maximum melt level 3. On the rim 2 of the bottom vessel there is mounted, with a slight set-back, the removable furnace wall 4. The furnace wall consists, in the example selected, of a plurality of water cooling boxes 5/1, 5/2, 5/3 . . . 5/*n* in the form of hollow ring segments whose surface area per segment, on the side facing the interior of the furnace, does not exceed about 3 square meters, and which are assembled by a framework, which is not shown, into a self-supporting lower section, of annular shape, of the furnace wall 4. This annular section furthermore contains adjacent the tap hole 6 of the furnace a brick lining 7 defined by the bath level when the furnace is tilted, so as to assure that, when the furnace is tapped, the water cooling boxes 5 will not come in contact with the melt. To prevent this reliably, the passage cross-sectional area of the tap hole 6 is increased, in comparison to known furnaces, to more than 500 $cm^2$, and preferably to more than 750 $cm^2$, and, above the tap hole and below the bottom edge of the water cooling box 5/3 directly above it, a safety hole 8 is provided, which is about 10 to 20 cm below the bottom edge of this water cooling box. The safety hole serves to enable the personnel operating the furnace to see, when they are tapped the furnace, that the bath level remains sufficiently far below the water cooling box above it. If molten material is flowing from the safety hole, this level has been reached and the furnace must not be tilted any further. The safety hole does not have to be above the tap hole, but can also be located laterally beside it. Its height will then be determined by the line of the maximum allowable bath level when the furnace is tilted.

Above the water cooling boxes 5/1 . . . 5/*n* constructed in the form of hollow segments of a circle, an additional water cooling box 10 is disposed so as to form a top section of the furnace wall 4. This cooling box is constructed in the form of a hollow annular element extending all the way around the furnace, and is divided circumferentially into individual chambers 10/1, 10/2 . . . 10/*m* (see FIG. 2). The water cooling boxes 5/1 . . . 5/*n* and the individual chambers 10/1 . . . 10/*m* of water cooling box 10 are connected each independently of the other by feed lines 11 and discharge lines 12 to a cooling water supply system, which can extend around the furnace in the form of annular pipes (see FIG. 5).

In FIG. 2 the three electrodes 13 of the arc furnace are also represented.

According to one feature of the invention, the thickness of the wall of the water cooling boxes facing the inside of the furnace, contrary to the former conception and practice, is not limited to from 9 to 12 mm, but is made greater than 15 mm, preferably 20 to 35 mm. This permits not only an improved distribution of heat in the refractory composition applied to the water cooling boxes (this idea will be further explained with reference to FIGS. 7 to 12), but also, on account of the greater rigidity of the water cooling boxes, a self-supporting type of construction and hence an additional simplification in the furnace wall design. Furthermore, in the event of an exceptional local exposure of the furnace wall to the arc, the danger of a burn-out by the arc is reduced. The undesirable consequences of the tendency of the steel walls to crack due to their greater thickness can, however, also be conteracted effectively by additional measures, as will be explained in connection with FIGS. 3 and 4.

Figure 3:
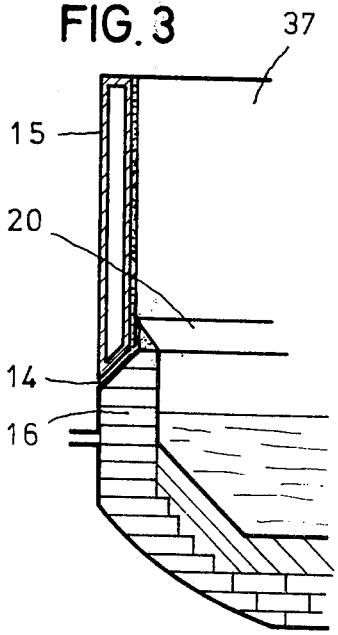
Figure 4:
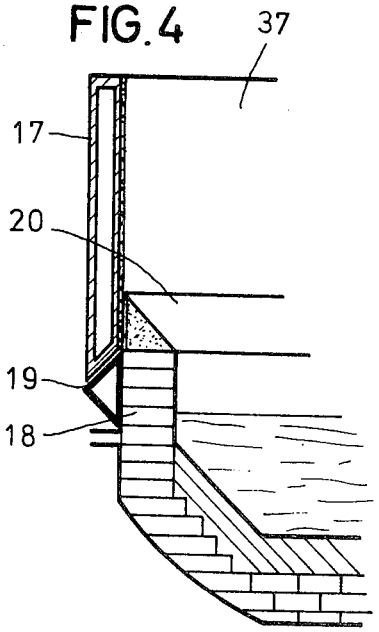

FIGS. 3 and 4 are cross-sectional views of the parts of the melting furnaces of the invention with which we are concerned. These parts contain safeguards for preventing any water that might escape from the water cooling boxes from flowing into the molten bath. For this purpose, in the design represented in FIG. 3, the flange 14 between the bottom edge of a hollow annular water cooling box 15 and the upper rim of the brickwork 16 of a circular furnace slopes outwardly and downwardly, and furthermore the cooling box wall facing the inside of the furnace is set back slightly from the inside face of the furnace brickwork 16. Thus, in the event of a leak of the cooling box side facing the inside of the furnace, the descending water will flow outwardly. In the case of the embodiment represented in FIG. 4, the water cooling box 17 is set even further back than than it is in the embodiment shown in FIG. 3, through the use of a likewise outwardly and downwardly sloping flange 19. In both cases, the seam between the water cooling boxes and the furnace brickwork is sealed from inside the furnace with a refractory composition 20, and, in variance from the embodiment shown in FIG. 1, only one water cooling box is provided in the axial direction.

Circumferentially, this cooling box can be constructed with chambers similarly to water cooling box 10, or a plurality of segment-shaped water cooling boxes can be provided circumferentially, like the water cooling boxes 5 of FIG. 1.

The embodiments represented in FIGS. 5 and 6 are two examples of the design possibilities which are opened by the greater rigidity of the water cooling boxes due to their greater wall thickness.

In the embodiment shown in FIG. 5, a plurality of hollow segmental water cooling boxes 21 are provided similarly to the middle section of the furnace of FIG. 1. These lie on the furnace brickwork 22 and produce a cooling of the uppermost bricks thereof. Each of the water cooling boxes has at its upper edge an outwardly extending flange 23 which rests on a reinforcing member 24 of an outer frame 25. The flange is provided with holes, which are not shown, and which make it possible to lift out the water cooling boxes with a crane and replace them when necessary. FIG. 5 also shows the annular pipes 26 and 27, previously mentioned above in connection with FIG. 1, for the input and discharge of the cooling water supply to the individual cooling boxes. Also shown are the baffles 28 which guide the cooling water along a meandering or wavelike path from the bottom to the top of the cooling water box.

FIG. 6 shows a construction of the furnace wall in which wall sections composed of hollow segmental water cooling boxes 29 and 30 are alternated with wall sections composed of refractory bricks 31. The holding frame here consists of only two hollow rings 32 and 33 spaced apart vertically by uprights 34 disposed around the circumference. Due to the greater wall thickness of the water cooling boxes, they are capable of withstanding the heavy weight imposed upon them without any additional separate support. Also, as the drawing shows, they are set back slightly from the bricks. The embodiment represented in FIG. 6 is especially advantageous when, in certain applications, such as for example the melting of sponge iron, the proportion of water-cooled surfaces in the furnace wall is to be reduced. The spraying on of the refractory composition is best performed after the furnace vessel has been assembled.

In the melting furnace of the invention, the wall of the water cooling box or boxes facing the inside of the furnace is provided with projections made of profile irons, and the refractory protective layer is a refractory composition applied beforehand, i.e., before the furnace is placed in service. FIG. 7 presents an enlarged view of section VII of FIG. 1, and shows, in addition to the wall 35 facing the inside of the furnace, the projections formed of profile irons 36, and the refractory composition 37 which is applied beforehand. The profile irons 36 are preferably welded onto the wall 35 and have a length between 20 and 50 mm. Since the refractory protective layer is not first formed by the spattering of slag, as in the case of the known furnace of the kind described in the beginning, and instead a refractory composition 37 applied beforehand serves as the refractory layer, the profile irons 36 are protected from the outset, and this, in conjunction with their shape, which on account of the greater area of contact with the refractory composition assures a better heat transfer and hence a better distribution of heat in the refractory composition, also assures greater stability of the refractory composition and of the profile irons. The refractory composition can be applied by ramming or by spraying, by centrifugal force, or by troweling. The appropriate method for the application of the refractory composition will depend on the composition used and on the design of the profile irons. A composition of high thermal conductivity and high melting point is especially suitable as the refractory composition. Good experience has been obtained with compositions on a magnesite basis.

Figure 8:
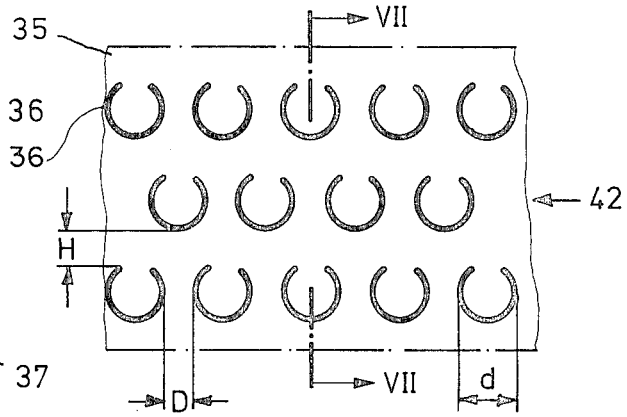

The profile irons 36 can be of various shapes. Those profiles are advantageous which, in addition to providing a great area of contact for the refractory composition, holds it well and in addition has the property of catching the slag spatter, thereby also contributing to the formation of a protective coating of slag spatter if, after a long period of operation, the refractory composition applied beforehand is locally damaged. The shape of profile iron 36 represented in FIG. 8 has proven especially advantageous for this purpose. FIG. 8 is an elevational view of the wall 35 of a water cooling box which faces the inside of the furnace, prior to the application of the refractory composition. The profile irons in this case are in the form of sections of longitudinally slotted pipe or tubing in which the slot opening extends over approximately one-fourth to two-fifths of the circumference; these pipe sections are offset from one another vertically, and the slotted side is facing upward. In this manner the refractory composition is tightly grasped, on the one hand, and on the other hand downwardly dripping slag spatter will be trapped and held by the open-topped profile irons in the event of local damage to the protective coating.

It has proven to be advantageous to array the slotted pipe sections 36 in rows 42 running approximately circumferentially about the furnace, the distance D separating the individual pipe sections of a row being 1 to 1.5 times the outside diameter *d* of a pipe section, and the distance H separating the individual rows amounting to 1.5 to 2 times the said outside diameter *d*.

Figure 9:
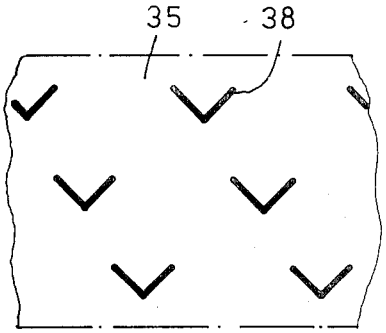
Figure 10:
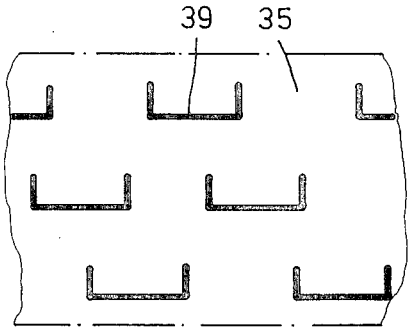
Figure 11:
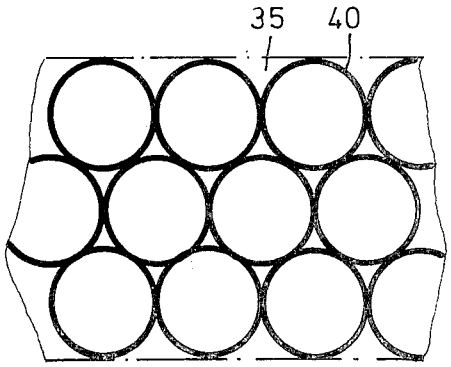
Figure 12:
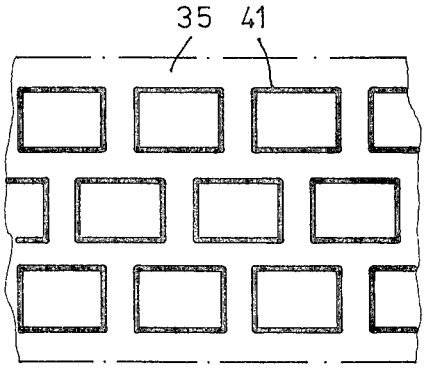

FIGS. 9 to 12 show additional advantageous shapes of profile irons. In the case of FIG. 9, the projections 38 are V-shaped, in FIG. 10 the projections 39 are U-shaped, and in the case of FIGS. 11 and 12 the projections 40 and 41, respectively, are hollow tubular profile irons.

We claim:

1. A melting furnace, especially an arc melting furnace, having a furnace wall containing at least one water cooling box disposed above the melt level of the furnace, the surface of the box facing the furnace interior being provided with projections, said wall of the water cooling box which faces the furnace interior having a thickness of at least 15 mm, the projections being formed of profile irons, and a refractory composition pre-applied on said surface and said projections and serving as a refractory protective layer prior to operation of said furnace, thereby to prevent damage to said surface and projection and facilitating adhesion of a further refractory protective layer of slag forming during operation of said furnace.

2. A melting furnace according to claim 1, wherein said wall of said water cooling box facing the furnace interior has a thickness between 20 mm and 35 mm.

3. A melting furnace according to claim 1, wherein said projections have a length of 20 mm to 50 mm.

4. A melting furnace according to claim 1, wherein said projections are constructed as hollow profile irons.

5. A melting furnace according to claim 4, wherein said projections are constructed as upwardly open hollow profile irons.

6. A melting furnace according to claim 5, wherein said projections are constructed as pipe sections having slots in axial direction, the width of said slots approximately over one-fourth to two-fifths of the circumference of the respective pipe section.

7. A melting furnace according to claim 1, wherein said projections are disposed offset from one another in the axial direction of the furnace.

8. A melting furnace according to claim 6, wherein said slotted pipe sections are disposed in rows running approximately in the circumferential direction of the furnace and the mutual clear spacing of the individual pipe sections of a row amounts to 1 to 1.5 times, and the clear spacing of the individual rows amounts to 1.5 to 2 times the outside diameter of a pipe section.

9. A melting furnace according to claim 1, wherein at least one water cooling box is constructed as a hollow annular element which is divided in the circumferential direction into individual chambers adapted to be separately supplied with cooling water, and which forms an annular section of the furnace wall.

10. A melting furnace according to claim 1, wherein at least one water cooling box is constructed as a hollow ring sectorshaped element and a frame combines several of said water cooling boxes to form a self-supporting, closed, annular section of the furnace wall.

11. A melting furnace especially an arc melting furnace, having a furnace wall containing at least one water cooling box disposed above the melt level of the furnace, the surface of the box facing the furnace interior being provided with projections which facilitate the adhesion of a refractory protective layer formed on this surface, said wall of the water cooling box which faces the furnace interior having a thickness of at least 15 mm, the projections being formed of profile irons, and a refractory composition applied thereon serving as the refractory protective layer, said furnace comprising brickwork, and comprising means forming seams or flanges between said furnace brickwork and said water cooling boxes and between superimposed water cooling boxes, said means being so constructed that water flowing down on the inside of the furnace is caught and carried outwardly of said furnace.

12. A melting furnace according to claim 11, wherein the wall of the water cooling box which faces the furnace interior is offset outwardly in relation to the inside wall of the furnace brickwork below it, and the seams or flanges are constructed to slope downwardly and outwardly.

13. A melting furnace according to claim 1, comprising an outwardly directed flange at the top of at least one water cooling box and an outer frame having an annular reinforcement profile supporting said flange.

14. A melting furnace according to claim 1, wherein said furnace wall contains annular wall sections with water cooling boxes, and annular wall sections made of refractory bricks alternating in the axial direction of the furnace with the wall sections with water cooling boxes.

15. A melting furnace especially an arc melting furnace, having a furnace wall containing at least one water cooling box disposed above the melt level of the furnace, the surface of the box facing the furnace interior being provided with projections which facilitate the adhesion of a refractory protective layer formed on this surface, said wall of the water cooling box which faces the furnace interior having a thickness of at least 15 mm, the projections being formed of profile irons, and a refractory composition applied thereon serving as the refractory protective layer, said furnace having a tap hole and furnace brickwork elevated in the area of the tap hole such that, when the furnace is tipped, the molten material is prevented from coming in contact with the water cooling boxes.

16. A melting furnace according to claim 15, wherein said tap hole has a passage cross section of at least 500 $cm^2$.

17. A melting furnace according to claim 16, wherein said passage cross section is at least 750 $cm^2$.

18. A melting furnace according to claim 15, wherein a safety hole is provided in the furnace brickwork above said tap hole.

19. A melting furnace according to claim 18, wherein the distance between said safety hole and the bottom edge of the first water cooling box above it amounts to approximately 10 to 15 cm.

* * * * *

UNITED STATES PATENT AND TRADEMARK OFFICE

CERTIFICATE OF CORRECTION

PATENT NO. : 4,119,792

DATED : October 10, 1978

INVENTOR(S) : Emil A. Elsner, et al

It is certified that error appears in the above-identified patent and that said Letters Patent are hereby corrected as shown below:

-- [73] Korf-Stahl AG, Baden-Baden, Fed. Rep. of Germany, a part interest --

Signed and Sealed this

*Twelfth* Day of *February 1980*

[SEAL]

*Attest:*

SIDNEY A. DIAMOND

*Attesting Officer*

*Commissioner of Patents and Trademarks*